US009777249B2

(12) United States Patent
Himmrich et al.

(10) Patent No.: US 9,777,249 B2
(45) Date of Patent: Oct. 3, 2017

(54) LIQUID SURFACTANT-CONTAINING ALKANOLAMINE-FREE COMPOSITIONS

(71) Applicant: WeylChem Swtizerland AG, Muttenz (CH)

(72) Inventors: Johannes Himmrich, Eppstein (DE); Hans Jürgen Scholz, Alzenau (DE); Wolfgang Walther, Kriftel (DE); Joachim Erbes, Frankfurt am Main (DE); Stefan Riegelbeck, Frankfurt (DE)

(73) Assignee: WeylChem Switzerland AG, Muttenz (CN)

( * ) Notice: Subject to any disclaimer, the term of this patent is extended or adjusted under 35 U.S.C. 154(b) by 0 days.

(21) Appl. No.: 14/419,500

(22) PCT Filed: Aug. 7, 2013

(86) PCT No.: PCT/EP2013/002367
§ 371 (c)(1),
(2) Date: Feb. 4, 2015

(87) PCT Pub. No.: WO2014/023427
PCT Pub. Date: Feb. 13, 2014

(65) Prior Publication Data

US 2015/0299624 A1 Oct. 22, 2015

(30) Foreign Application Priority Data

Aug. 9, 2012 (DE) ..... 10 2012 015 826

(51) Int. Cl.

| | |
|---|---|
| ***C11D 1/02*** | (2006.01) |
| ***C11D 1/66*** | (2006.01) |
| ***C11D 1/72*** | (2006.01) |
| ***C11D 1/83*** | (2006.01) |
| ***C11D 3/386*** | (2006.01) |
| ***C11D 3/39*** | (2006.01) |
| ***B08B 3/04*** | (2006.01) |
| ***C11D 3/395*** | (2006.01) |
| ***C11D 1/831*** | (2006.01) |
| ***C11D 10/04*** | (2006.01) |
| *C11D 1/14* | (2006.01) |

(52) U.S. Cl.
CPC ..... *C11D 3/3956* (2013.01); *C11D 1/83* (2013.01); *C11D 1/831* (2013.01); *C11D 3/3907* (2013.01); *C11D 3/3942* (2013.01); *C11D 3/3947* (2013.01); *C11D 10/04* (2013.01); *C11D 1/143* (2013.01); *C11D 1/72* (2013.01)

(58) Field of Classification Search
CPC .... C11D 1/02; C11D 1/66; C11D 1/72; C11D 1/83; C11D 3/386; C11D 3/39; B08B 3/04
See application file for complete search history.

(56) References Cited

U.S. PATENT DOCUMENTS

| | | | | | |
|---|---|---|---|---|---|
| 3,128,287 | A | | 4/1964 | Berg | |
| 3,159,581 | A | | 12/1964 | Diehl | |
| 3,213,030 | A | | 10/1965 | Diehl | |
| 3,400,148 | A | | 9/1968 | Quimby | |
| 3,422,137 | A | | 1/1969 | Quimby | |
| 3,998,750 | A | * | 12/1976 | Payne | C11D 1/83 510/325 |
| 4,566,984 | A | | 1/1986 | Bush | |
| 4,663,071 | A | | 5/1987 | Bush et al. | |
| 4,664,839 | A | | 5/1987 | Rieck | |
| 5,271,860 | A | | 12/1993 | Schwadtke et al. | |
| 5,441,672 | A | * | 8/1995 | Schwadtke | C11D 3/3765 510/321 |
| 5,518,645 | A | | 5/1996 | Beaujean et al. | |
| 7,541,326 | B2 | | 6/2009 | Lang | |
| 8,729,001 | B2 | * | 5/2014 | Himmrich | C11D 1/83 510/155 |
| 8,987,179 | B2 | * | 3/2015 | Himmrich | C11D 3/2068 510/155 |
| 2008/0103080 | A1 | * | 5/2008 | Lang | C11D 10/04 510/407 |

FOREIGN PATENT DOCUMENTS

| | | | | | |
|---|---|---|---|---|---|
| DE | 4023893 | A1 | | 1/1992 | |
| DE | 4216453 | A1 | | 11/1993 | |
| DE | 19511192 | A1 | | 10/1996 | |
| DE | 102004043728 | A1 | | 6/2005 | |
| EP | 0458397 | A2 | | 11/1991 | |
| EP | 0458398 | A2 | | 11/1991 | |
| EP | 490436 | | * | 6/1992 | C11D 11/00 |
| EP | 0490436 | A1 | | 6/1992 | |
| EP | 0549272 | A1 | | 6/1993 | |

(Continued)

OTHER PUBLICATIONS

International Search Report dated Dec. 2, 2013.
International Preliminary Report on Patentability dated Feb. 19, 2015.

*Primary Examiner* — Brian P Mruk
(74) *Attorney, Agent, or Firm* — Michael W. Ferrell

(57) ABSTRACT

Liquid compositions include:

a) one or more anionic surfactants and b) one or more nonionic surfactants, wherein they comprise the surfactants of components a) and b) in a total concentration of >25% by weight, based on the total weight of the liquid composition, and are free from alkanolamines and salts thereof.

Upon combination with bleaches, the liquid compositions exhibit a significantly higher bleaching efficacy than comparable alkanolamine-containing compositions.

17 Claims, No Drawings

(56) References Cited

FOREIGN PATENT DOCUMENTS

| | | | |
|---|---|---|---|
| EP | 1445305 | A1 | 8/2004 |
| EP | 1520910 | A1 | 4/2005 |
| EP | 1557457 | A1 | 7/2005 |
| WO | 9220769 | | 11/1992 |
| WO | 9606154 | A1 | 2/1996 |
| WO | 9606157 | A1 | 2/1996 |
| WO | 2006125517 | A1 | 11/2006 |
| WO | 2011095308 | A1 | 8/2011 |

* cited by examiner

LIQUID SURFACTANT-CONTAINING ALKANOLAMINE-FREE COMPOSITIONS

CLAIM FOR PRIORITY

This application is a national phase application of PCT/EP2013/002367 FILED Aug. 7, 2013 which was based on application DE 10 2012 015 826.2 FILED Aug. 9, 2012. The priorities of PCT/EP2013/002367 and DE 10 2012 015 826.2 are hereby claimed and their disclosures incorporated herein by reference.

BACKGROUND

The invention relates to liquid compositions which comprise a high overall concentration of anionic and nonionic surfactants, but are free from alkanolamines and salts thereof. The liquid compositions can be used for the washing and cleaning of textiles and, in combination with bleaching systems, exhibit an advantageous bleaching efficacy.

Liquid detergents are enjoying greatly increasing popularity in the market because they can be dosed easily and without dust formation, they rapidly release the washing-active ingredients upon washing and, moreover, they do not leave behind residues on the laundry. In this connection, in recent years, a trend has also caught on for ever more concentrated liquid detergents in order to be able to produce small, easy-to-handle packaging units and to reduce transportation costs.

The production of highly concentrated liquid detergents necessitates the use of very readily soluble surfactants, hydrotropes and solvents. In such products, the use of anionic surfactants in the form of their very readily soluble ethanolamine salts and also the use of ethanolamines as solvents is very widespread.

A major disadvantage of the liquid detergents is their low compatibility with bleaching systems and, resulting therefrom, their poor detergency on bleachable soilings.

The object was therefore to provide concentrated compositions, in particular with a high surfactant fraction, which, when used with bleaching systems, permit an advantageous removal of bleachable soilings during washing.

SUMMARY OF INVENTION

Surprisingly, it has been found that this object is achieved by liquid compositions which comprise a) one or more anionic surfactants and b) one or more nonionic surfactants and wherein they comprise the surfactants of components a) and b) in a total concentration of >25% by weight, based on the total weight of the liquid compositions, and are free from alkanolamines and salts thereof.

The invention therefore provides liquid compositions comprising a) one or more anionic surfactants and b) one or more nonionic surfactants, wherein they comprise the surfactants of components a) and b) in a total concentration of >25% by weight, based on the total weight of the liquid compositions, and are free from alkanolamines and salts thereof.

When combined with bleaching systems, the compositions according to the invention exhibit a significantly higher bleaching efficacy than comparable, alkanolamine-containing compositions.

DETAILED DESCRIPTION

Within the context of the present invention, "liquid" compositions according to the invention are understood as meaning all liquid or flowable presentation forms. Within the context of the present invention, liquid or flowable compositions are those which are pourable and have viscosities of from 5 to 60 000 mPas. The viscosity can be measured using customary standard methods (for example Brookfeld viscometer LVT-II at 20 revolutions/minute and at 20° C.), wherein spindle 2 is used for the viscosity range 5 to <1000 mPas, spindle 3 is used for 1000 to <5000 mPas, spindle 4 is used for 5000 to <10 000 mPas and spindle 7 is used for 10 000 to 60 000 mPas.

Preferably, the liquid compositions according to the invention have viscosities of from 100 to 20 000 mPas, particularly preferably from 300 to 10 000 mPas and especially preferably from 400 to 5000 mPas.

The compositions according to the invention can be gel-like or paste-like, they may be present as homogeneous solutions or as suspensions, they can be sprayable, be supplied in so-called pouches or be confectioned in otherwise customary presentation forms.

Preferably, the compositions according to the invention comprise one or more anionic surfactants selected from the group consisting of the surfactant classes of the sulfonates, sulfates, carboxylates and phosphates and particularly preferably they comprise one or more anionic surfactants selected from the group consisting of the surfactant classes of the sulfonates, sulfates and carboxylates. Of these, preference is in turn given to compositions according to the invention where the one or more anionic surfactants of component a) are selected from the group consisting of the surfactant classes of the sulfonates, sulfates, carboxylates and phosphates and particularly preferably selected from the group consisting of the surfactant classes of the sulfonates, sulfates and carboxylates. Suitable counterions of the anionic surfactants are the cations of sodium, potassium, calcium and magnesium.

The compositions according to the invention are free from alkanolamines and salts thereof. This means for example that these substances are also not contemplated as counterions of the anionic surfactants.

Preferred sulfonates are secondary paraffinsulfonates. Secondary paraffinsulfonates are surfactants which contain, in statistical distribution, predominantly one $SO_3X$ group in the secondary position on the paraffin hydrocarbon chain and, to a lesser extent, two or more $SO_3X$ groups in the secondary position on the paraffin hydrocarbon chain (X=counterion). The paraffin hydrocarbon chains are predominantly linear and only to a small fraction of 5% by weight or less branched paraffin chains having 8 to 22 carbon atoms. Particular preference is given to secondary paraffinsulfonates having 13 to 17 carbon atoms in the paraffin group.

Furthermore, preference is given to primary sulfonates, preferably alkane- or alkenesulfonates, where the alkyl or alkenyl group can either be branched or linear and can be optionally substituted with a hydroxyl group. The preferred primary sulfonates contain linear alkyl or alkenyl chains having 9 to 25 carbon atoms, preferably having 10 to 20 carbon atoms and particularly preferably having 13 to 17 carbon atoms.

Preference is likewise given to olefinsulfonates which are obtained by sulfonation of $C_{12}$-$C_{24}$-, preferably $C_{14}$-$C_{16}$-α-olefins with sulfur trioxide and subsequent neutralization. As a consequence of the preparation process, these olefinsulfonates can contain relatively small amounts of hydroxyalkanesulfonates and alkanedisulfonates.

Preference is likewise given to alkenyl- or alkylbenzenesulfonates. The alkenyl or alkyl group can be branched or linear and optionally substituted with a hydroxyl group. The preferred alkylbenzenesulfonates contain linear alkyl chains having 9 to 25 carbon atoms and preferably having 10 to 13 carbon atoms.

Preference is likewise given to ester sulfonates of the formula (1)

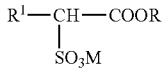

(1)

in which $R^1$ is a $C_8$-$C_{20}$-hydrocarbon radical, preferably alkyl, and R is a $C_1$-$C_6$ hydrocarbon radical, preferably alkyl. M is a cation, which forms a water-soluble salt with the ester sulfonate.

Particular preference is given to methyl ester sulfonates, in which $R^1$ is $C_{10}$-$C_{16}$-alkyl and R is methyl.

Preferred sulfates are water-soluble salts of the formula $ROSO_3M$, in which R is a $C_{10}$-$C_{24}$-hydrocarbon radical, preferably an alkyl or hydroxyalkyl radical with $C_{10}$-$C_{20}$-alkyl component, particularly preferably a $C_{12}$-$C_{18}$ alkyl or hydroxyalkyl radical. M is sodium, potassium, calcium, magnesium or a mixture thereof.

Preferred ether sulfates are water-soluble salts of the linear formula $RO(A)_mSO_3M$ in which R is an unsubstituted $C_{10}$-$C_{24}$-hydrocarbon radical, preferably $C_{10}$-$C_{24}$-alkyl radical, or is a $C_{10}$-$C_{24}$-hydrocarbon radical substituted by a hydroxyl group, preferably a $C_{10}$-$C_{24}$-hydroxyalkyl radical, particularly preferably a $C_{12}$-$C_{20}$ alkyl or hydroxyalkyl radical, especially preferably a $C_{12}$-$C_{18}$-alkyl or hydroxyalkyl radical. A is an ethoxy (EO) or propoxy (PO) unit, m is a number greater than 0, preferably between 0.5 and 6, particularly preferably between 0.5 and 3 and M is a cation such as e.g. sodium, potassium, calcium, magnesium or a mixture thereof.

Particular preference is given to $C_{12}$- to $C_{18}$-fatty alcohol ether sulfates, where the content of EO is 1, 2, 2.5, 3 or 4 mol per 1 mol of the fatty alcohol ether sulfate and in which M is sodium or potassium.

Further preferred anionic surfactants are carboxylates, in particular fatty acid soaps. The soaps can be saturated or unsaturated and can contain various substituents, such as hydroxyl groups or α-sulfonate groups. Preference is given to linear saturated or unsaturated hydrocarbon radicals as hydrophobic fraction having 6 to 30 and preferably 10 to 18 carbon atoms.

Particular preference is given to the salts of lauric acid, myristic acid, palmitic acid, stearic acid, behenic acid, hydrogenated erucic acid, oleic acid, linoleic acid, linolenic acid and mixtures thereof and the salts of the fatty acids or fatty acid mixtures of natural fats and oils, preferably of coconut oil, soybean oil, rapeseed oil, sunflower oil, canola oil, palm fat oil, palm kernel oil, olive oil and tallow fat.

Among the one or more anionic surfactants of component a) of the compositions according to the invention, the secondary paraffinsulfonates are particularly preferred.

Preferably, the compositions according to the invention comprise one or more nonionic surfactants selected from the group consisting of the surfactant classes of the alkoxylated fatty alcohols, fatty acid amides, alkoxylated fatty acid amides, alkylphenol polyglycol ethers, amine oxides, polyhydroxy fatty acid amides and alkyl polyglycosides. Among these, preference is in turn given to compositions according to the invention where the one or more nonionic surfactants of component b) are selected from the group consisting of the surfactant classes of the alkoxylated fatty alcohols, fatty acid amides, alkoxylated fatty acid amides, alkylphenol polyglycol ethers, amine oxides, polyhydroxy fatty acid amides and alkyl polyglycosides.

The alkyl or alkenyl chain of the alkoxylated fatty alcohols can be linear or branched, primary or secondary, and contains in general 8 to 22 carbon atoms. Particular preference is given to the condensation products of $C_{10}$- to $C_{20}$-alcohols with 2 to 18 mol of ethylene oxide per 1 mol of alcohol. The alcohol ethoxylates can have a narrow homolog distribution of the ethylene oxide ("Narrow Range Ethoxylates") or a broad homolog distribution of the ethylene oxide ("Broad Range Ethoxylates"). Examples of commercially obtainable nonionic surfactants of this type are Tergitol® 15-S-9 (condensation product of a linear secondary $C_{11}$-$C_{15}$-alcohol with 9 mol of ethylene oxide), Tergitol® 24-L-NMW (condensation product of a linear primary $C_{12}$-$C_{14}$-alcohol with 6 mol of ethylene oxide for a narrow molecular weight distribution). This product class likewise includes the Genapol® brands from Clariant.

Preference is given to fatty acid amides according to formula (2)

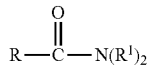

(2)

in which R is an alkyl group having 7 to 21, preferably 9 to 17, carbon atoms and each radical $R^1$ is hydrogen, $C_1$-$C_4$-alkyl, $C_1$-$C_4$-hydroxyalkyl or $(C_2H_4O)_xH$, where x varies from 1 to 3. Preference is given to $C_8$-$C_{20}$-amides, -monoethanolamides, -diethanolamides and -isopropanolamides.

Preference is likewise given to polyethylene, polypropylene and polybutylene oxide condensates of alkylphenols. These compounds include the condensation products of alkylphenols with a $C_6$- to $C_{20}$-alkyl group, which can either be linear or branched, with alkene oxides. These surfactants are referred to as alkylphenol alkoxylates, e.g. alkylphenol ethoxylates.

Furthermore, preference is given to water-soluble amine oxides of the formula (3)

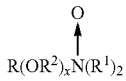

(3)

Here, R is an alkyl, hydroxyalkyl or alkylphenol group with a chain length from 8 to 22 carbon atoms, $R^2$ is an alkylene or hydroxyalkylene group with 2 to 3 carbon atoms or mixtures thereof, each radical $R^1$ is an alkyl or hydroxyalkyl group having 1 to 3 carbon atoms or a polyethylene oxide group having 1 to 3 ethylene oxide units and x is a number from 0 to 10.

Preference is likewise given to using polyhydroxy fatty acid amides of the formula (4)

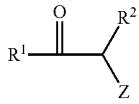

(4)

where $R^1CO$ is an aliphatic acyl radical having 6 to 22 carbon atoms, $R^2$ is hydrogen, an alkyl or hydroxyalkyl radical having 1 to 4 carbon atoms and Z is a linear or branched polyhydroxyalkyl radical having 3 to 10 carbon atoms and 3 to 10 hydroxyl groups.

Preference is likewise given to alkyl polyglycosides of the formula $RO(G)_x$, where R is a primary straight-chain or methyl-branched, in particular 2-methyl-branched, aliphatic radical having 8 to 22, preferably 12 to 18 carbon atoms, and G is a glucose unit having 5 or 6 carbon atoms, preferably glucose. The degree of oligomerization x, which indicates the distribution of monoglycosides and oligoglycosides, is preferably a number between 1 and 10, particularly preferably x is between 1.2 and 1.4.

Among the one or more nonionic surfactants of component b) of the compositions according to the invention, the alkoxylated fatty alcohols are particularly preferred.

In a further preferred embodiment of the invention, the compositions according to the invention comprise the surfactants of components a) and b) in a total concentration of from 30 to 50% by weight and particularly preferably from 35 to 45% by weight, in each case based on the total weight of the compositions according to the invention.

In a further preferred embodiment of the invention, the compositions according to the invention comprise the surfactants of components a) and b) in a total concentration of >50% by weight and particularly preferably from 50 to 80% by weight, in each case based on the total weight of the compositions according to the invention.

Preferably, the anionic surfactants of component a) and the nonionic surfactants of component b) are present in the compositions according to the invention in a weight ratio of component a) to component b) of from 10:1 to 1:10, particularly preferably from 5:1 to 1:5, especially preferably from 3:1 to 1:3 and extraordinarily preferably from 2:1 to 1:2.

Besides the aforementioned anionic and nonionic surfactants, further constituents which may be present in the compositions according to the invention are also amphoteric and cationic surfactants, bleaches, bleach activators, bleach catalysts, builders, cobuilders, washing alkalis, enzymes, sequestrants, soil release polymers, graying inhibitors, color transfer inhibitors, color fixatives, complexing agents, optical brighteners, softening components, dyes, fragrances, emulsifiers, hydrotropes, organic solvents, and also water.

Suitable amphoteric and zwitterionic surfactants are alkylbetaines, alkylamidobetaines, aminopropionates, aminoglycinates or amphoteric imidazolinium compounds according to the formula (5)

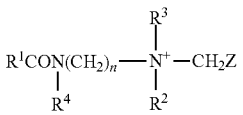

(5)

in which $R^1$ is $C_8$-$C_{22}$-alkyl or -alkenyl, $R^2$ is hydrogen or $CH_2CO_2M$, $R^3CH_2CH_2OH$ or $CH_2CH_2OCH_2CH_2CO_2M$, $R^4$ is hydrogen, $CH_2CH_2OH$ or $CH_2CH_2COOM$, Z is $CO_2M$ or $CH_2CO_2M$, n is 2 or 3, preferably 2, M is hydrogen or a cation such as alkali metal, alkaline earth metal.

Preferred amphoteric surfactants of this formula are monocarboxylates and dicarboxylates. Examples thereof are cocoamphocarboxypropionate, cocoamidocarboxypropionic acid, cocoamphocarboxyglycinate (or also referred to cocoamphodiacetate) and cocoamphoacetate.

Further preferred amphoteric surfactants are alkyldimethylbetaines and alkyldipolyethoxybetaines with an alkyl radical having 8 to 22 carbon atoms, which can be linear or branched, preferably having 8 to 18 carbon atoms and particularly preferably having 12 to 18 carbon atoms. These compounds are marketed e.g. by Clariant under the trade name Genagen® LAB.

If the compositions according to the invention comprise one or more amphoteric surfactants, these are preferably present therein in an amount of from 0.1-10% by weight and particularly preferably in an amount of from 0.5-5% by weight, in each case based on the total weight of the compositions according to the invention.

Suitable cationic surfactants are substituted or unsubstituted straight-chain or branched quaternary ammonium salts of the type $R^1N(CH_3)_3{}^{\rho}X^{\sigma}$, $R^1R^2N(CH_3)_2{}^{\rho}X^{\sigma}$, $R^1R^2R^3N(CH_3)^{\rho}X^{\sigma}$ or $R^1R^2R^3R^4N^{\rho}X^{\sigma}$. The radicals $R^1$, $R^2$, $R^3$ and $R^4$ can preferably, independently of one another, be unsubstituted alkyl with a chain length of 8 to 24 carbon atoms, in particular of 10 to 18 carbon atoms, hydroxyalkyl having 1 to 4 carbon atoms, phenyl, $C_2$- to $C_{18}$-alkenyl, $C_7$- to $C_{24}$-aralkyl, $(C_2H_4O)_xH$, where x is from 1 to 3, alkyl radicals containing one or more ester groups, or cyclic quaternary ammonium salts. X is a suitable anion.

Further suitable cationic surfactants are quaternary alkylhydroxyalkylammonium salts according to the formula (6)

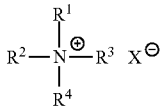

(6)

where $R^1$ is a linear or branched, saturated or unsaturated alkyl group having 5 to 22 carbon atoms, preferably 8 to 18 carbon atoms, particularly preferably 8 to 14 carbon atoms, $R^2$ is a methyl group, $R^3$ is a methyl group or like $R^4$ is a group of the formula $-A-(OA)_n-OH$, where A can be a $—C_2H_4-$ and/or $—C_3H_6-$group and n can be a number from 0 to 20.

X can be any desired anion, for example chloride, bromide, iodide, fluoride, sulfate, hydrogensulfate, carbonate, hydrogencarbonate, acetate, citrate, phosphate, mono- and dihydrogenphosphate, pyrophosphate, polyphosphate, metaphosphate, nitrate, methylsulfate, phosphonate, methylphosphonate, methanedisulfonate, methylsulfonate, ethanesulfonate or an anion of the formulae $R^6SO_3^{\ominus}$, $R^7SO_4^{\ominus}$ or $R^6COO^{\ominus}$, in which $R^6$ and $R^7$ are $C_2$-$C_{20}$-, preferably $C_{10}$-$C_{18}$-alkyl, and $R^7$ is additionally also $C_1$-$C_{18}$-alkylphenyl.

Quaternary $C_{8-10}$-alkyldimethylhydroxyethylammonium chloride or -methosulfate and quaternary $C_{12-14}$-alkyldimethylhydroxyethylammonium chloride or -methosulfate is extraordinarily preferred.

If the compositions according to the invention comprise one or more cationic surfactants, these are preferably present therein in an amount of from 0.1-15% by weight and particularly preferably in an amount of 0.5-7% by weight, in each case based on the total weight of the compositions according to the invention.

If the compositions according to the invention comprise one or more cationic surfactants, the weight ratio of the one or more cationic surfactants to the one or more anionic surfactants is preferably from 1:10 to 1:5.

Suitable bleaches are hydrogen peroxide and inorganic persalts, preferably percarbonates, perborates, persulfates and persilicates, especially in the form of alkali metal salts. Particularly preferred bleaches are hydrogen peroxide, sodium perborate (monohydrate and tetrahydrate) and/or sodium percarbonate, particularly preferably sodium perborate (monohydrate and tetrahydrate) and/or sodium percarbonate.

If the compositions according to the invention comprise one or more of the bleaches just mentioned, they must not comprise a bleach activator. In this case, they preferably also do not contain a bleach catalyst.

If the compositions according to the invention comprise one or more bleaches, these are present therein preferably in an amount of 1-25% by weight, particularly preferably 5-20% by weight and especially preferably 8-16% by weight, in each case based on the total weight of the composition according to the invention.

The compositions according to the invention must contain no peracids or salts thereof.

In a preferred embodiment of the invention, the compositions according to the invention comprise no bleach, i.e. they are free from bleach.

If the compositions according to the invention comprise no bleach, they can comprise one or more bleach activators.

As bleach activators, the compositions according to the invention can comprise one or more substances selected from the following group: polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyloxy- or n-lauroyloxybenzenesulfonate (NOBS or LOBS), acylated phenolcarboxylic acids, in particular nonanoyloxy- or decanoyloxybenzoic acid (NOBA or DOBA), carboxylic anhydrides, in particular phthalic anhydride, acylated polyhydric alcohols, in particular triacetin, ethylene glycol diacetate and 2,5-diacetoxy-2,5-dihydrofuran, and acylated sorbitol and mannitol, or mixtures thereof (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam. Hydrophilically substituted acylacetals and acyllactams are likewise preferably used. In addition, nitrile derivatives such as n-methylmorpholinium acetonitrile methylsulfate (MMA) or cyanomorpholine (MOR) can be used as bleach activators. Combinations of conventional bleach activators can also be used.

Particularly preferred bleach activators are tetraacetylethylenediamine, decanoyloxybenzoic acid, n-nonanoyloxybenzenesulfonate or n-lauroyloxybenzenesulfonate.

If the compositions according to the invention comprise one or more bleach activators, these are present therein preferably in an amount of 1-10% by weight, particularly preferably in an amount of 1-6% by weight and especially preferably in an amount of 2-5% by weight, in each case based on the total weight of the composition according to the invention.

In a preferred embodiment of the invention, the compositions according to the invention comprise no bleach activator, i.e. they are free from bleach activator.

In a particularly preferred embodiment of the invention, the compositions according to the invention comprise no bleach and no bleach activator.

Suitable bleach catalysts are preferably bleach-boosting transition metal salts or complexes of manganese, iron, cobalt, ruthenium, molybdenum, titanium or vanadium. When using metal salts, preference is given in particular to manganese salts in oxidation states +2 or +3, for example manganese halides, the chlorides being preferred, manganese sulfates, manganese salts of organic acids such as manganese acetates, manganese acetyl acetonates, manganese oxalates, and manganese nitrates.

Furthermore, preference is given to complexes of iron in oxidation states II or III and of manganese in oxidation states II, III, IV or IV, which preferably contain one or more macrocyclic ligand(s) with the donor functions N1 NR, PR, O and/or S. Preference is given to using ligands which have nitrogen donor functions. Preference is given to transition metal complexes which contain, as macromolecular ligands, 1,4,7-trimethyl-1,4,7-triazacyclononane (Me-TACN), 1,4,7-triazacyclononane (TACN), 1,5,9-trimethyl-1.[delta].[theta]-triazacyclododecane (Me-TACD), 2-methyl-1,4,7-trimethyl-1,4,7-triazacyclononane (MeMeTACN) and/or 2-methyl-1,4,7-triazacyclononane (Me/TACN) or bridged ligands such as 1,2-bis-(4,7-dimethyl-1,4,7-triazacyclonono-1-yl) ethane (Me4-DTNE) or derivatives of cyclam or cyclen, such as 1,8-dimethylcyclam, 1,7-dimethylcyclen, 1,8-diethylcyclam, 1,7-diethylcyclen, 1,8-dibenzylcyclam and 1,7-dibenzylcyclen, as are described e.g. in EP 0 458 397, EP 0458 398, EP 0 549 272, WO 96/06154, WO 96/06157 or WO 2006/125517, but in addition also manganese complexes as are known from EP 1 445 305, EP 1 520 910, EP 1 557 457 and WO 2011/095308.

If the compositions according to the invention comprise one or more bleach catalysts, these are present therein preferably in an amount of from 0.001 to 2% by weight, based on the total weight of the compositions according to the invention.

Further ingredients which may be present in the compositions according to the invention include inorganic and/or organic builders and cobuilders, so-called builders, in order to reduce the degree of water hardness.

These builders can be present in the compositions according to the invention with weight fractions of from 5 to 80%. Inorganic builders include, for example, alkali metal, ammonium and alkanolammonium salts of polyphosphates such as, for example, tripolyphosphates, pyrophosphates and glass-like polymeric metaphosphates, phosphonates, silicates, carbonates including bicarbonates and sesquicarbonates, sulfates and aluminosilicates.

Examples of silicate builders are the alkali metal silicates, in particular those with an $SiO_2$:$Na_2O$ ratio between 1.6:1 and 3.2:1, and also sheet silicates, for example sodium sheet silicates, as described in U.S. Pat. No. 4,664,839, available from Clariant under the brand SKS®. SKS-6® is a particularly preferred sheet silicate builder.

Aluminosilicate builders are particularly preferred. These are in particular zeolites with the formula $Na_z[(AlO_2)_z(SiO_2)_y].xH_2O$, in which z and y are integers of at least 6, the ratio of z to y is from 1.0 to 0.5, and x is an integer from 15 to 264.

Suitable ion exchangers based on aluminosilicate are commercially available. These aluminosilicates may be of crystalline or amorphous structure, and can be naturally occurring or else prepared synthetically.

Preferred ion exchangers based on synthetic crystalline aluminosilicates are available under the name Zeolith A, Zeolith P(B) (including those disclosed in EP-A-0 384 070) and Zeolith X.

Suitable organic builders including polycarboxyl compounds, such as, for example, etherpolycarboxylates and oxydisuccinates, as described for example in U.S. Pat. Nos. 3,128,287 and 3,635,830. Likewise, reference should be made to "TMS/TDS" builders from U.S. Pat. No. 4,663,071.

Other suitable builders including the ether hydroxypolycarboxylates, copolymers of acrylic acid with maleic anhydride, of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of polyacetic acids such as e.g. ethylenediaminetetraacetic acid and nitrilotriacetic acid, and also polycarboxylic acids, such as mellitic acid, succinic acid, oxydisuccinic acid, polymaleic acid, benzene-1,3,5-tricarboxylic acid, carboxymethyloxysuccinic acid, and soluble salts thereof.

Builders based on citrate, e.g. citric acid and its soluble salts, in particular the sodium salt, are preferred polycarboxylic acid builders, which can also be used together with zeolites and/or sheet silicates.

Further suitable builders are the 3,3-dicarboxy-4-oxa-1,6-hexanedioates and the related compounds which are disclosed in U.S. Pat. No. 4,566,984.

If builders based on phosphorus can be used, various alkali metal phosphates such as, for example, sodium tripolyphosphate, sodium pyrophosphate and sodium orthophosphate, can be used. It is likewise possible to use phosphonate builders, such as ethane-1-hydroxy-1,1-diphosphonate and other known phosphonates, as are disclosed for example in U.S. Pat. Nos. 3,159,581, 3,213,030, 3,422,021, 3,400,148 and 3,422,137.

The compositions according to the invention can comprise washing alkalis which increase the pH of the composition. Carbonates, hydrogencarbonates and silicates, in particular alkali metal carbonates, alkali metalhydrogencarbonates and alkali metal silicates with a molar ratio of $SiO_2/M_2O$ (M=alkali metal atom) of 1:1 to 2.5:1 are suitable.

Enzymes which can be used are conventional enzymes. Preferably, the compositions according to the invention comprise one or more enzymes selected from the group consisting of proteases, amylases, mannases, lipases, endolases, pectinases, cellulases, pullinases, cutinases and peroxidases.

Available proteases are, for example, Liquanase® Ultra 2.0 XL, BLAP®, Opticlean®, Maxacal®, Maxapem®, Esperase®, Savinase®, Purafect®, OxP and/or Duraxym®, available amylases are, for example, Steinzyme® Plus 12L, Termamyl®, Amylase® LT, Maxamyl®, Duramyl® and/or Pruafect® Ox, available mannases are, for example, Mannaway 4.0 L, available lipases are, for example, Lipex® 100 L, Lipolase®, Lipomax®, Lumafast® and/or Lipozym®, available endolases are, for example, Endolase® 5000L, available pectinases are, for example, Pectinex 3X L and/or Pectinex Ultra SPL and available cellulases are, for example, Carezyme 1000 L and/or Celluclast 1.5 L.

Preferably, the compositions according to the invention comprise at least 0.001% by weight, particularly preferably 0.01 to 10% by weight, particularly preferably 0.1 to 5% by weight and extraordinarily preferably 1 to 3% by weight, of one or more enzymes, in each case based on the total weight of the compositions according to the invention.

Available sequestrants are sodium tripolyphosphate (STPP), ethylenediaminetetracetic acid (EDTA) and salts, nitrilotriacetic acid (NTA), polyacrylate, phosphonate, oxalic acid and salt, citric acid, zeolite, condensed phosphates, carbonates, polycarbonates.

Suitable Soil Release Polymers (SRPs) are polyesters obtainable by polymerization of the components selected from one or more sulfo-group-free aromatic dicarboxylic acids and/or salts thereof, one or more sulfo-group-containing dicarboxylic acids, one or more compounds of the formula $R^1O(CHR^2CHR^3O)_nH$, where $R^1$ is H, a linear or branched alkyl or alkenyl group having 1 to 22 carbon atoms, preferably $C_1$-$C_4$-alkyl and particularly preferably methyl, $R^2$ and $R^3$, independently of one another, are hydrogen or an alkyl group having 1 to 4 carbon atoms, preferably hydrogen and/or methyl, and n is a number from 1 to 100, one or more compounds of the formula $H—(OCH_2CH_2)_m—SO_3X$, where m is a number from 1 to 100 and X is hydrogen or an alkali metal ion, and one or more crosslinking polyfunctional compounds.

In a preferred embodiment of the invention, the compositions according to the invention comprise one or more Soil Release Polymers. If the compositions according to the invention comprise one or more Soil Release Polymers, these are present therein preferably in an amount of from 0.1 to 10% by weight and particularly preferably in an amount of from 0.2 to 3% by weight, in each case based on the total weight of the compositions according to the invention.

Suitable graying inhibitors are carboxymethylcellulose, methylcellulose, hydroxyalkylcellulose, methylhydroxyethylcellulose, methylhydroxypropylcellulose, methylcarboxymethylcellulose and polyvinylpyrrolidone.

Color transfer inhibitors are also contemplated, for example polyamine N-oxides such as, for example, poly(4-vinylpyridine N-oxide), e.g. Chromabond S-400, ISP; polyvinylpyrrolidone, e.g. Sokalan® HP 50, BASF and copolymers of N-vinylpyrrolidone with N-vinylimidazole and optionally other monomers.

The compositions according to the invention can also comprise color fixatives, for example color fixatives which are obtained by reacting diethylenetriamine, dicyandiamide and amidosulfuric acid, amines with epichlorohydrin, for example dimethylaminopropylamine and epichlorohydrin or dimethylamine and epichlorhydrin or dicyandiamide, formaldehyde and ammonium chloride, or dicyandiamide, ethylenediamine and formaldehyde or cyanamide with amines and formaldehyde or polyamines with cyanamides and amidosulfuric acid or cyanamides with aldehydes and ammonium salts, but also polyamine N-oxides such as, for example, poly-(4-vinylpyridine N-oxide), e.g. Chromabond S-400, ISP; polyvinylpyrrolidone, e.g. Sokalan® HP 50, BASF and copolymers of N-vinylpyrrolidone with N-vinylimidazole and optionally other monomers.

The compositions according to the invention can comprise complexing agents, for example aminocarboxylates, such as ethylenediamine tetraacetate, N-hydroxyethylethylenediamine triacetate, nitrilotriacetate, ethylenediamine tetrapropionate, triethylenetetraamine hexaacetate, diethylenetriamine pentaacetate, cyclohexanediamine tetraacetate, phosphonates, for example azacycloheptanediphosphonate, Na salt, pyrophosphates, etidronic acid (1-hydroxyethylidene-1,1-diphosphonic acid, 1-hydroxyethane-1,1-diphosphonic acid, acetophosphonic acid) and its salts, aminophosphonates, such as ethylenediamine tetrakis (methylenephosphonat), diethylenetriamine pentakis (methylenephosphonate), aminetrimethylenephosphonic acid, cyclodextrins, and polyfunctionally substituted aromatic complexing agents, such as dihydroxydisulfobenzene or ethylenediamine disuccinates.

Optical brighteners which can be used are cyclic hydrocarbons such as distyrylbenzenes, distyrylbiphenyls, diphenylstilbenes, triazinylaminostilbenes, stilbenyl-2H-triazoles, for example stilbenzyl-2H-naphthol-[1,2-d]triazoles and bis(1,2,3-triazol-2-yl)stilbenes, benzoxazoles, for example stilbenylbenzoxazole and bis(benzoxazole), furans, benzofurans and benzimidazoles, for example bis(benzo[b]furan-2-yl)biphenyl and cationic benzimidazoles, 1,3-diphenyl-2-pyrazoline, coumarin, naphthalimides, 1,3,5-2-yl derivatives, methinecyanin and dibenzothiophene 5,5-oxide.

Preference is given to anionic optical brighteners, in particular sulfonated compounds.

Also suitable are triazinylaminostilbenes, distyrylbiphenyls and mixtures thereof, 2-(4-styrylphenyl)-2H-naphtho[1,2-d]triazole, 4,4'-bis-(1,2,3-triazol-2-yl)stilbene, aminocoumarin, 4-methyl-7-ethylaminocoumarin, 1,2-bis(benzimidazol-2-yl)ethylene, 1,3-diphenylpyrazoline, 2,5-bis(benzooxazol-2-yl)thiophene, 2-styryl-naphtho[1,2-d]oxazole, 2-(4-styryl-3-sulfophenyl)-2H-naphtho[1,2-d]triazole and 2-(stilben-4-yl)-2H-naphthol[1,2-d]triazole.

If the compositions according to the invention comprise one or more optical brighteners, these are present therein preferably in amounts of from 0.001 to 2% by weight, particularly preferably in amounts of from 0.002 to 0.8% by weight and especially preferably in amounts of from 0.003 to 0.4% by weight, in each case based on the total weight of the compositions according to the invention.

Softening components which can be used are quaternary ammonium salts of the type

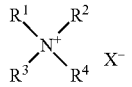

in which $R^1$=$C_8$-$C_{24}$ n- or isoalkyl, preferably $C_{10}$-$C_{18}$ n-alkyl, $R^2$=$C_1$-$C_4$-alkyl, preferably methyl, $R^3$=$R^1$ or $R^2$, $R^4$=$R^2$ or hydroxyethyl or hydroxypropyl or oligomers thereof and $X^-$=bromide, chloride, iodide, methosulfate, acetate, propionate or lactate.

Examples thereof are distearyldimethylammonium chloride, ditallowalkyldimethylammonium chloride, ditallowalkylmethylhydroxypropylammonium chloride, cetyltrimethylammonium chloride or else the corresponding benyzl derivatives such as, for example, dodecyldimethylbenzylammonium chloride. Cyclic quaternary ammonium salts, such as, for example, alkylmorpholine derivatives can likewise be used.

Moreover, besides the quaternary ammonium compounds, imidazolinium compounds (1) and imidazoline derivatives (2) can be used.

(1)

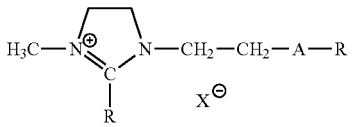

-continued (2)

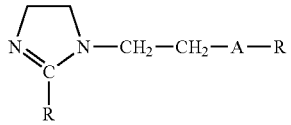

in which

R=$C_8$-$C_{24}$ n- or isoalkyl, preferably $C_{10}$-$C_{18}$ n-alkyl,

X=bromide, chloride, iodide or methosulfate and

A=—NH—CO—, —CO—NH—, —O—CO— or —CO—O—.

A particularly preferred compound class is the so-called ester quats. These are reaction products of alkanolamines and fatty acids which are then quaternized with customary alkylating agents or hydroxyalkylating agents.

Examples of ester quats are compounds of the formulae:

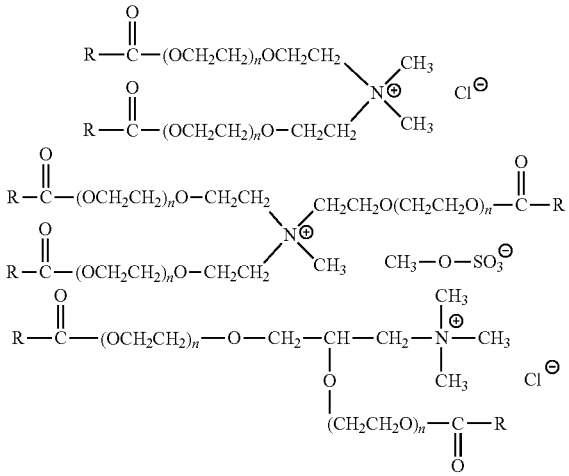

where R—C—O is derived from $C_8$-$C_{24}$-fatty acids, which may be saturated or unsaturated. The index n is in the range from 0 to 10, preferably in the range from 0 to 3 and particularly preferably in the range from 0 to 1.

Further preferred fabric softener raw materials are amidoamines based on, for example, trialkyltriamines and long-chain fatty acids, and also their oxethylates and quaternized variants. These compounds have the following structure:

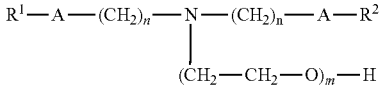

in which $R^1$ and $R^2$ independently of one another, are $C_8$-$C_{24}$ n- or isoalkyl, preferably $C_{10}$-$C_{18}$ n-alkyl, A is —CO—NH— or —NH—CO—, n is 1 to 3, preferably 2, and m is 1 to 5, preferably 2 to 4.

By quaternizing the tertiary amino group, it is possible to additionally introduce a radical $R^3$, which may be $C_1$-$C_4$-alkyl, preferably methyl, and a counterion X, which may be chloride, bromide, iodide or methylsulfate. Amidoaminoethoxylates and quaternized subsequent products thereof are supplied under the trade names Varisoft® 510, Varisoft® 512, Rewopal® V 3340 and Rewoquat® W 222 LM.

The compositions according to the invention preferably comprise dyes and fragrances or perfumes.

As dyes, preference is given to Acid Red 18 (CI 16255), Acid Red 26, Acid Red 27, Acid Red 33, Acid Red 51, Acid Red 87, Acid Red 88, Acid Red 92, Acid Red 95, Acid Red 249 (CI)18134, Acid Red 52 (CI45100), Acid Violet 126, Acid Violet 48, Acid Violet 54, Acid Yellow 1, Acid Yellow 3 (CI 47005), Acid Yellow 11, Acid Yellow 23 (CI 19140), Acid Yellow 3, Direct Blue 199 (CI 74190), Direct Yellow 28 (CI 19555), Food Blue 2 (CI 42090), Food Blue 5:2 (CI 42051:2), Food Red 7 (CI 16255), Food Yellow 13 (CI 47005), Food Yellow 3 (CI 15985), Food Yellow 4 (CI 19140), Reactive Green 12, Solvent Green 7 (CI 59040).

Particularly preferred dyes are water-soluble acid dyes, for example Food Yellow 13 (Acid Yellow 3, CI 47005), Food Yellow 4 (Acid Yellow 23, CI 19140), Food Red 7 (Acid Red 18, CI 16255), Food Blue 2 (Acid Blue 9, CI 42090), Food Blue 5 (Acid Blue 3, CI 42051), Acid Red 249 (CI 18134), Acid Red 52 (CI 45100), Acid Violet 126, Acid Violet 48, Acid Blue 80 (CI 61585), Acid Blue 182, Acid Blue 182, Acid Green 25 (CI 61570), Acid Green 81.

Water-soluble direct dyes, for example Direct Yellow 28 (CI 19555), Direct Blue 199 (CI 74190) and water-soluble reactive dyes, for example Reactive Green 12, and the dyes Food Yellow 3 (CI 15985), Acid Yellow 184 can also likewise preferably be used.

Aqueous dispersions of the following pigment dyes can likewise preferably be used, the concentration of the dye dispersions used for coloring solutions or dispersions preferably being in the range from 0.1 to 50% by weight, particularly preferably in the range from 1 to 45% by weight, especially preferably in the range from 5 to 40% by weight and extraordinarily preferably in the range from 10 to 35% by weight.

It is known to the person skilled in the art that besides the pigments, the aqueous pigment dispersions comprise dispersants and optionally further auxiliaries, for example biocides.

Suitable pigment dyes are Pigment Black 7 (CI 77266), Pigment Blue 15 (CI 74160), Pigment Blue 15:1 (CI 74160), Pigment Blue 15:3 (CI 74160), Pigment Green 7 (CI 74260), Pigment Orange 5, Pigment Red 112 (CI 12370), Pigment Red 112 (CI 12370), Pigment Red 122 (CI 73915), Pigment Red 179 (CI 71130), Pigment Red 184 (CI 12487), Pigment Red 188 (CI 12467), Pigment Red 4 (CI 12085), Pigment Red 5 (CI 12490), Pigment Red 9, Pigment Violet 23 (CI 51319), Pigment Yellow 1 (CI 11680), Pigment Yellow 13 (CI 21100), Pigment Yellow 154, Pigment Yellow 3 (CI 11710), Pigment Yellow 74, Pigment Yellow 83 (CI 21108), Pigment Yellow 97.

In a preferred embodiment of the invention, the following pigment dyes are used in the form of dispersions: Pigment Yellow 1 (CI 11680), Pigment Yellow 3 (CI 11710), Pigment Red 112 (CI 12370), Pigment Red 5 (CI 12490), Pigment Red 181 (CI 73360), Pigment Violet 23 (CI 51319), Pigment Blue 15:1 (CI 74160), Pigment Green 7 (CI 74260), Pigment Black 7 (CI 77266).

In a further preferred embodiment of the invention, water-soluble polymer dyes, for example Liquitint®, Liquitint Blue HP®, Liquitint Blue 65®, Liquitint Patent Blue®, Liquitint Royal Blue®, Liquitint Experimental Yellow 8949-43®, Liquitint Green HMC®, Liquitint Yellow II® and mixtures thereof are used.

Fragrances or perfumes which can be used are individual odorant compounds, e.g. the synthetic products of the ester, ether, aldehyde, ketone, alcohol and hydrocarbon types. Fragrance compounds of the ester type, e.g. benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethylmethylphenyl glycinate, allylcyclohexyl propionate, styrallyl propionate and benzyl salicylate. The ethers include, for example, benzyl ethyl ether; the aldehydes include e.g. the linear alkanals having 8 to 18 carbon atoms, citral, citronellal, citronellyloxyacetaldehyde, hydroxycitronellal, lilial and bourgeonal; the ketones include e.g. the ionons, alpha-isomethylionone and methyl cedryl ketone; the alcohols include anethol, citronellol, eugenol, geraniol, linalool, phenylethyl alcohol and terpineol; the hydrocarbons include primarily the terpenes and balsams. Preference is given to using mixtures of different odorants which together produce a pleasant scent note.

Perfume oils can also comprise natural odorant mixtures, as are accessible from vegetable or animal sources, e.g. pine oil, citrus oil, jasmine oil, lily oil, rose oil or ylang-ylang oil. Essential oils of relatively low volatility, which are mostly used as aroma components, are also suitable as perfume oils, e.g. sage oil, chamomile oil, clove oil, melissa oil, mint oil, cinnamon leaf oil, linden blossom oil and juniper berry oil.

Preference is given to using solutions or emulsions of the aforementioned fragrances and perfume oils, which can be prepared by customary methods.

Suitable emulsifiers are addition products of from 0 to 30 mol of alkylene oxide, in particular ethylene oxide, propylene oxide and/or butylene oxide, onto linear or branched, saturated or unsaturated fatty alcohols having 8 to 22 carbon atoms, onto fatty acids having 12 to 22 carbon atoms, onto alkylphenols having 8 to 15 carbon atoms in the alkyl group and onto sorbitan esters;

($C_{12}$-$C_{18}$)-fatty acid mono- and diesters of addition products of from 0 to 30 mol of ethylene oxide onto gycerol;

glycerol mono- and diesters and sorbitan mono- and diesters of saturated and unsaturated fatty acids having 6 to 22 carbon atoms and optionally ethylene oxide addition products thereof;

addition products of from 5 to 60 mol, preferably 15 to 60 mol, of ethylene oxide onto castor oil and/or hydrogenated castor oil;

polyol and in particular polyglycerol esters, such as e.g. polyglycerol polyricinoleate and polyglycerol poly-12-hydroxystearate.

Furthermore, anionic emulsifiers, such as ethoxylated and non-ethoxylated mono-, di- or triphosphoric acid esters, but also cationic emulsifiers such as mono-, di- and trialkyl quats and polymeric derivatives thereof can be used.

Mixtures of compounds from two or more of these substance classes are likewise suitable.

Suitable hydrotropes are xylenesulfonates, toluenesulfonates and cumenesulfonates in the form of their potassium or sodium salts or mixtures thereof.

In a preferred embodiment of the invention, the compositions according to the invention comprise one or more hydrotropes in an amount of 1-10% by weight, preferably in an amount of 1-6% by weight and particularly preferably in an amount of 2-5% by weight, in each case based on the total weight of the compositions according to the invention.

Preferred organic solvents originate from the group of mono- or polyhydric alcohols or glycol ethers. Preferably, the solvents are selected from ethanol, n- or isopropanol, butanol, glycol, propane- or butanediol, glycerol, diglycol, propyl or butyl diglycol, hexylene glycol, ethylene glycol methyl ether, ethylene glycol ethyl ether, ethylene glycol propyl ether, etheylene glycol mono-n-butyl ether, diethylene glycol methyl ether, diethylene glycol ethyl ether, propylene glycol methyl, ethyl or propyl ether, dipropylene glycol methyl, or ethyl ether, methoxy-, ethoxy- or butoxytriglycol, 1-butoxyethoxy-2-propanol, 3-methyl-3-methoxybutanol, propylene glycol t-butyl ether, polyglycols, preferably polyethylene glycols, and mixtures of these solvents.

Furthermore, the compositions according to the invention comprise water.

In a preferred embodiment of the invention, the amount of water in the compositions according to the invention is 10 to 60% by weight, preferably 10 to 40% by weight and particularly preferably 10 to 20% by weight, in each case based on the total weight of the compositions according to the invention.

In a further preferred embodiment of the invention, the amount of water in the compositions according to the invention is <10% by weight, preferably <8% by weight, particularly preferably <6% by weight and especially preferably <5% by weight, in each case based on the total weight of the compositions according to the invention. The minimum amount of water here is preferably 3% by weight, based on the total weight of the compositions according to the invention.

The compositions according to the invention have a pH of preferably 7 to 11, particularly preferably from 7.5 to 10 and especially preferably from 7.5 to 8.5.

However, it is known to the person skilled in the art that the pH of a liquid composition with a water fraction <40% by weight, based on the total weight of the liquid composition, cannot be ascertained for the liquid composition per se. For liquid compositions with a water fraction <40% by weight, a 1% strength by weight aqueous solution of the liquid composition is prepared and the pH of this is determined by customary methods.

Consequently, the pH values given above are valid for compositions according to the invention with a water fraction of 40% by weight or greater (based on the total weight of the compositions according to the invention) directly and for compositions according to the invention with a water fraction <40% by weight (based on the total weight of the compositions according to the invention), for a 1% strength by weight aqueous solution of the composition according to the invention.

The compositions according to the invention can be used in the presence of one or more bleaches advantageously for the cleaning of textiles, and in particular for removing bleachable soilings on textiles.

The invention therefore further provides the use of a composition according to the invention in the presence of one or more bleaches for the cleaning of textiles and in particular for the removal of bleachable soilings on textiles.

For the use according to the invention, the compositions according to the invention exhibit in particular a significantly stronger detergency than comparable alkanoline- or alkanolamine-salt-containing compositions.

For the use according to the invention, the compositions according to the invention can comprise one or more bleaches, as already described above.

For the use according to the invention, the composition according to the invention can be combined with one or more bleaches, which are used separately from the composition according to the invention. This can also be the case if the composition according to the invention already comprises bleaches.

In a preferred embodiment of the invention, however, the use takes place in such a way that the composition according to the invention comprises no bleach, but, upon use, is combined with one or more bleaches.

Bleaches which can be combined with the composition according to the invention for the use according to the invention are to be understood firstly as meaning compounds which react with bleach activators and in so doing form peroxyacids which bleach more effectively than the bleaches on their own at low temperatures (e.g. <70° C.).

Suitable bleaches of this type are hydrogen peroxide and inorganic persalts, preferably percarbonates, perborates, persulfates and persilicates, especially in the form of alkali metal salts. Particularly preferred bleaches of this type are hydrogen peroxide, sodium perborate (monohydrate and tetrahydrate) and/or sodium percarbonate, especially preferably sodium perborate (monohydrate and tetrahydrate) and/or sodium percarbonate.

Bleaches which must not be present in the composition according to the invention but which can be combined with the composition according to the invention for the use according to the invention are to be understood as meaning, on the other hand, compounds which work without bleach activator. Suitable bleaches of this type are peracids or salts thereof.

Particularly preferably peracids or peracid salts are peroxycarboxylic acids and salts thereof according to the formula

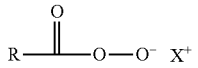

where R is an alkyl group, aralkyl group, cycloalkyl group, aryl group or heterocyclic group, preferably a linear or branched, substituted or unsubstituted alkyl group, especially preferably an alkyl group having 6 to 9 carbon atoms, and $X^+$ is a suitable counterion, preferably an $H^+$, potassium ion or sodium ion. Preference is given to peroxyhexanoic acid, peroxyheptanoic acid, peroxyoctanoic acid, peroxynonanoic acid, peroxydecanoic acid and salts thereof.

Further particularly preferred peracids or peracid salts are peroxysulfonic acids and salts thereof according to the formula

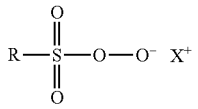

where R is an alkyl group, aralkyl group, cycloalkyl group, aryl group or heterocyclic group, preferably a linear or branched, substituted or unsubstituted alkyl group, especially preferably an alkyl group having 6 to 9 carbon atoms, and $X^+$ is a suitable counterion, preferably $H^+$, a potassium ion or sodium ion.

Furthermore particularly preferred peracids or peracid salts are peroxophthalic acids and salts thereof, phthalimidoperacids and salts thereof, diperoxycarboxylic acids and salts thereof or peroxysulfuric acids and salts thereof.

Among the bleaches which work without the bleach activator, preference is given in particular to the peracids or salts thereof which are selected from the group consisting of monoperoxyphthalic acid and its salts, N,N-phthalimidoperhexanoic acid (PAP) and its salts, diperazelaic acid and its salts, diperdodecanedioic acid and its salts and monoperoxysulfuric acid and its salts, the salts preferably being selected from the sodium salts and/or potassium salts. Among monoperoxysulfuric acid and its salts, preference is given in particular to potassium peroxymonosulfate (available under the trade name Caroat).

For the use according to the invention, the one or more bleaches is or are used in an amount of preferably 1-25% by weight, particularly preferably 5-20% by weight and especially preferably 8-16% by weight, based on the total weight of the composition according to the invention. The stated amount of bleach is the total amount of bleach employed for the use according to the invention, which arises from the amount of beach in the composition according to the invention and the amount of bleach added separately from the composition according to the invention.

The one or more bleaches can be used for the use according to the invention either without a bleach activator or with one or more bleach activators.

In a preferred embodiment of the use according to the invention, this takes place in the presence of one or more bleach activators.

For the use according to the invention, the composition according to the invention as described above can already comprise a bleach activator.

For the use according to the invention, the composition according to the invention can be combined with one or more bleach activators which are used separately from the composition according to the invention. This can also be the case if the composition according to the invention already comprises bleach activator.

In a preferred embodiment of the invention, however, the use takes place in such a way that the composition according to the invention comprises no bleach activator, but is combined with one or more bleach activators upon use.

It is known to the person skilled in the art that the use of bleach activator is useful only in the presence of bleach.

In a preferred embodiment of the invention, bleach activator is used together with bleach in a physical mixture but separate from the composition according to the invention. In this preferred embodiment of the invention, the physical mixture of bleach activator and bleach is in solid form at 25° C. If, for the use according to the invention, bleach activator is used together with bleach in a physical mixture, the composition according to the invention preferably comprises neither bleach nor bleach activator.

In a further preferred embodiment of the invention, bleach activator is used separately from bleach and separately from the composition according to the invention. If, for the use according to the invention, bleach activator is used separately from bleach and separately from the composition according to the invention, the composition according to the invention preferably comprise neither bleach or bleach activator.

For the use according to the invention, the bleach activators used are the same as those already specified above in the description of the compositions according to the invention. The bleach activators listed there as being preferred are also preferred for the use according to the invention. This is the case both when the one or more bleach activators are present in the composition according to the invention and also when they are added additionally to the composition according to the invention for the use according to the invention.

If bleach activators are used for the use according to the invention, they are used in such a way that, based on the total weight of the compositions according to the invention, they are preferably present in an amount of 1-10% by weight, particularly preferably in an amount of 1-6% by weight and especially preferably in an amount of 2-5% by weight. The stated amount of bleach activator is the total amount of bleach activator used for the use according to the invention, which arises from the amount of bleach activator in the composition according to the invention and the amount of bleach activator added separately from the composition according to the invention.

The wash liquor should have a pH of preferably 8.0 to 11.0, particularly preferably of 8.5 to 10.5 and especially preferably of 9.0 to 10.0, in order to achieve an adequate bleaching result. The increase in the pH in the wash liquor can be achieved by washing alkalis, for example sodium carbonate.

The washing temperature is preferably from 20 to 80° C., particularly preferably from 30 to 60° C. and especially preferably from 40 to 60° C.

The examples below are intended to illustrate the invention without limiting it thereto. Unless explicitly stated otherwise, all percentages are to be understood as meaning percentages by weight (% by weight).

Washing experiments were carried out with the following formulations.

Formulation A, Ethanolamine-Containing

| | Composition | % by weight (Active substance) |
|---|---|---|
| A | Hostapur ® SAS 93<br>Sec. sodium paraffinsulfonate | 20.5 |
| B | Genapol ® OX 070 (Clariant)<br>$C_{12,15}$-oxo alcohol, 7 EO | 30.0 |
| C | Edenor ® K 12-18<br>Coconut fatty acid | 8.0 |
| | KOH (50% strength by weight in water) | |
| | Water | ad 100 |
| | Monoethanolamine | 5.0 |
| D | Genapol ® LRO paste (Clariant)<br>Active substance: Lauryl ether sulfate, 2EO (EO: Ethylene oxide unit), Na salt | 8.4 |
| | Cublen ® BIT 121<br>Phosphonate | 2.5 |
| | Texcare ® SRN 170<br>Nonionic polyester of polypropylene terephthalate, aqueous | 2.0 |
| | Leucophor ® BSB liq.<br>Optical brightener | 0.5 |
| | Propylene glycol | 10.0 |
| E | Ethanol | 2.0 |
| | ®Enzym-mix<br>Novozymes | 2.0 |

Preparation:

I Dissolution of A in B by heating.

II Subsequent addition and dissolution of components C in I.

III Subsequent addition of components D in II.

IV Cooling of III to room temperature and addition of E.

Formulation B, Ethanolamine-Free

| | Composition | % by weight (Active substance) |
|---|---|---|
| A | Hostapur ® SAS 93<br>Sec. sodium paraffinsulfonate | 20.5 |
| B | Genapol ® OX 070 (Clariant)<br>$C_{12,15}$-oxo alcohol, 7 EO | 30.0 |
| C | Edenor ® K 12-18<br>Coconut fatty acid | 8.0 |
| | KOH (50% strength by weight in water) | |
| | Water | ad 100 |

-continued

| | Composition | % by weight (Active substance) |
|---|---|---|
| D | Genapol ® LRO paste (Clariant) Active substance: Lauryl ether sulfate, 2EO (EO: Ethylene oxide unit), Na salt | 8.4 |
| | Cublen ® BIT 121 Phosphonate | 2.5 |
| | Texcare ® SRN 170 Nonionic polyester of polypropylene terephthalate, aqueous | 2.0 |
| | Leucophor ® BSB liq. Optical brightener | 0.5 |
| | Propylene glycol | 10.0 |
| E | Ethanol | 2.0 |
| | ®Enzym-mix Novozymes | 2.0 |

Preparation as Formulation A

The washing experiments were carried out under the following conditions:

Washing machine: Miele Novotronic W 927 WPS

Program: Boil/Colored

Loading: 3 kg

Temperature: 40° C.

Wash cycle: 3 times

Amount of water: 12 liters 30 g of each of the formulations A and B were dissolved in 500 ml of water immediately before being added to the washing machine, and 2 g of TAED, 4 g of sodium percarbonate and 11 g of soda were added to each solution. The resulting formulations are referred to below as formulation A1 and formulation B1.

The differences in reflectance values ΔR 457 nm between washed and unwashed cotton textiles were measured. The measured soiled textiles can be acquired commercially. The following six textiles/soilings were measured: CFT BC-1 (tea), CFT BC-3 (tea for low temperatures), CFT CS-3, (red wine), WFK 10K (coffee), CFT CS-15 (blueberry juice), CFT CS-8 (grass).

Measurement:

Instrument: Elrepho 3000 (Datacolor)

Aperture: XLAV Ø34 mm

Edge Filter: 400 nm

The measurements were taken directly after the formulations had been prepared.

Table A below shows the measured differences in the reflectance values ΔR 457 nm for all six soilings. Moreover, the sum of the measured differences in the reflectance values ΔR 457 nm is listed for all six soilings.

For the measurements, the formulations A1 and B1 were used with the aforementioned bleach additives.

TABLE A measured ΔR 457 nm values

| Soiling | ΔR 457 nm formulation A1 (Comparison) | ΔR 457 nm formulation B1 (Invention) |
|---|---|---|
| CFT BC-1 (Tea) | 9.6 | 11.1 |
| CFT BC-3 (Tea for low temperatures) | 8 | 9.5 |
| CFT CS-3 (Red wine) | 21.7 | 23.9 |
| WFK 10K (Coffee) | 32.8 | 34.8 |
| CFT CS-15 (Blueberry juice) | 38 | 39.6 |
| CFT CS-8 (Grass) | 23.9 | 25.4 |
| All 6 soilings | 134 | 144 |

The results in table A reveal that the monoethanolamine-free liquid formulation B according to the invention, in combination with the bleaching system consisting of sodium percarbonate and TAED, exhibits a better effect towards bleachable soilings than the monoethanolamine-containing liquid comparison composition A.

The invention claimed is:

1. A liquid composition comprising a) one or more anionic surfactants selected from secondary paraffinsulfonates, and b) one or more nonionic surfactants, c) water in an amount of 3-20% by weight, wherein the composition comprises the surfactants of components a) and b) in a total concentration of from 50-80% by weight, based on the total weight of the liquid composition, and is free from alkanolamines and salts thereof and wherein the weight ratio of component a) to component b) is from 2:1 to 1:2, and wherein further the composition contains 5-20% by weight of one or more bleaches selected from the group of hydrogen peroxide and inorganic persalts, based on the total weight of the liquid composition.

2. The liquid composition as claimed in claim 1, further comprising one or more additional anionic surfactants selected from the group consisting of the surfactant classes of the sulfonates, sulfates, carboxylates and phosphates and the counterions of the anionic surfactants are selected from the group consisting of the cations of sodium, potassium, calcium and magnesium.

3. The liquid composition as claimed in claim 1, further comprising one or more additional anionic surfactants which are selected from the group consisting of the salts of lauric acid, myristic acid, palmitic acid, stearic acid, behenic acid, hydrogenated erucic acid, oleic acid, linoleic acid, linolenic acid and mixtures thereof.

4. The liquid composition as claimed in claim 1, wherein the one or more nonionic surfactants of component b) are selected from the group consisting of the surfactant classes of the alkoxylated fatty alcohols, fatty acid amides, alkoxylated fatty acid amides, alkylphenol polyglycol ethers, amine oxides, polyhydroxy fatty acid amides and alkyl polyglycosides.

5. The liquid composition as claimed in claim 1, wherein it comprises one or more nonionic surfactants of component b) which are selected from condensation products of $C_{10}$- to $C_{20}$-alcohols with 2 to 18 mol of ethylene oxide per 1 mol of alcohol.

6. The liquid composition as claimed in claim 1, wherein it comprises one or more enzymes selected from the group consisting of proteases, amylases, mannases, lipases, endolases, pectinases, cellulases, pullinases, cutinases and peroxidases.

7. The liquid composition as claimed in claim 1, wherein it comprises one or more soil release polymers.

8. A liquid composition comprising a) one or more anionic surfactants selected from secondary paraffinsulfonates, and b) one or more nonionic surfactants, c) water in an amount of 10- 20% by weight, wherein the composition comprises the surfactants of components a) and b) in a total concentration of from 50-80% by weight, based on the total weight of the liquid composition, and is free from alkanolamines and salts thereof and wherein the weight ratio of component a) to component b) is from 2:1 to 1:2, and wherein further the composition contains 5-20% by weight of one or more bleaches selected from the group of hydrogen peroxide and inorganic persalts, based on the total weight of the liquid composition.

9. The liquid composition as claimed in claim 1, wherein it comprises water in an amount of <10% by weight, based on the total weight of the liquid composition.

10. A method of removing stains from textiles comprising utilizing the liquid composition of claim 1 in the presence of soiled textiles in order to remove stains from the soiled textiles.

11. The method as claimed in claim 10, wherein cleaning takes place in the presence of one or more bleach activators.

12. The method as claimed in claim 11, wherein the one or more bleach activators are selected from the group consisting of tetraacetylethylenediamine, decanoyloxybenzoic acid, n-nonanoyloxybenzenesulfonate and n-lauroyloxybenzenesulfonate.

13. The liquid composition as claimed in claim 1, further comprising one or more additional anionic surfactants which are selected from the group consisting of salts of fatty acids or salts of fatty acid mixtures of natural fats and oils.

14. The liquid composition as claimed in claim 1, further comprising one or more additional anionic surfactants which are selected from the group consisting of the salts of fatty acid mixtures of natural fats and oils, wherein the fats and oils are selected from coconut oil, soybean oil, rapeseed oil, sunflower oil, canola oil, palm fat oil, palm kernel oil, olive oil and tallow fat.

15. A method of cleaning and bleaching textiles comprising:

a) providing a liquid composition comprising i) one or more anionic surfactants selected from secondary paraffinsulfonates, and ii) one or more nonionic surfactants, iii) water in an amount of 3-20% by weight, wherein the composition comprises the surfactants of components a) and b) in a total concentration of from 50-80% by weight, based on the total weight of the liquid composition, and is free from alkanolamines and salts thereof and wherein the weight ratio of component a) to component b) is from 2:1 to 1:2, and wherein further the composition contains 5-20% by weight of one or more bleaches selected from the group of hydrogen peroxide and inorganic persalts, based on the total weight of the liquid composition as formulated;

b) combining the liquid composition with additional water applying a washing liquor including the liquid composition, and the additional water to the textiles.

16. The liquid composition as claimed in claim 1, wherein counter ions of the secondary paraffinsulfonates are cations of sodium, potassium or sodium and potassium.

17. The liquid composition as claimed in claim 1, wherein counter ions of the secondary paraffinsulfonates are selected from the group consisting of the cations of sodium, potassium, calcium and magnesium.

* * * * *